US010762841B2

(12) United States Patent
Ji et al.

(10) Patent No.: US 10,762,841 B2
(45) Date of Patent: Sep. 1, 2020

(54) PIXEL CIRCUIT, DRIVING METHOD THEREOF AND DISPLAY DEVICE

(71) Applicant: KunShan Go-Visionox Opto-Electronics Co., Ltd., Kunshan (CN)

(72) Inventors: Yanan Ji, Kunshan (CN); Wenzhi Fan, Kunshan (CN)

(73) Assignee: KunShan Go-Visionox Opto-Electronics Co., Ltd., Kunshan (CN)

( * ) Notice: Subject to any disclaimer, the term of this patent is extended or adjusted under 35 U.S.C. 154(b) by 0 days.

(21) Appl. No.: 16/439,034

(22) Filed: Jun. 12, 2019

(65) Prior Publication Data

US 2019/0295468 A1 Sep. 26, 2019

Related U.S. Application Data

(63) Continuation of application No. PCT/CN2018/092164, filed on Jun. 21, 2018.

(30) Foreign Application Priority Data

Oct. 31, 2017 (CN) ..... 2017 2 1426901 U

(51) Int. Cl.
*G09G 3/32* (2016.01)
*G09G 3/3233* (2016.01)
(Continued)

(52) U.S. Cl.
CPC ..... *G09G 3/3233* (2013.01); *G09G 3/22* (2013.01); *G09G 3/3208* (2013.01);
(Continued)

(58) Field of Classification Search
CPC ..... G09G 3/3233; G09G 2300/0814; G09G 2300/0819; G09G 2300/0809; G09G 2320/0223
See application file for complete search history.

(56) References Cited

U.S. PATENT DOCUMENTS

2016/0012780 A1 1/2016 Lee et al.
2016/0063922 A1* 3/2016 Tsai ..... G09G 3/3291 345/76
(Continued)

FOREIGN PATENT DOCUMENTS

CN 104050917 A 9/2014
CN 104658484 A 5/2015
(Continued)

OTHER PUBLICATIONS

International Search Report dated Sep. 17, 2018 in corresponding International application No. PCT/CN2018/092164; 5 pages.

*Primary Examiner* — Liliana Cerullo
(74) *Attorney, Agent, or Firm* — Maier & Maier, PLLC

(57) ABSTRACT

The disclosure discloses a pixel circuit and a driving method thereof, a display device. The pixel circuit includes a first through six thin film transistors, a light-emitting diode and a storage capacitor. A gate of the first thin film transistor is separately connected to a source of the second thin film transistor, a source of the third thin film transistor and one end of the storage capacitor. The other end of the storage capacitor is separately connected to a drain of the fourth thin film transistor and a source of the fifth thin film transistor. A source of the first thin film transistor is connected to a first power source. A drain of the first thin film transistor is separately connected to a drain of the second thin film transistor and a source of the sixth thin film transistor.

15 Claims, 4 Drawing Sheets

(51) Int. Cl.

| | |
|---|---|
| ***G09G 3/3266*** | (2016.01) |
| ***G09G 3/3291*** | (2016.01) |
| ***G09G 3/3208*** | (2016.01) |
| ***G09G 3/22*** | (2006.01) |

(52) U.S. Cl.
CPC ..... *G09G 3/3266* (2013.01); *G09G 3/3291* (2013.01); *G09G 2300/0426* (2013.01); *G09G 2300/0439* (2013.01); *G09G 2300/0809* (2013.01)

(56) References Cited

U.S. PATENT DOCUMENTS

| | | | | |
|---|---|---|---|---|
| 2016/0365035 | A1* | 12/2016 | Park | G09G 3/3266 |
| 2017/0294162 | A1* | 10/2017 | Hu | G09G 3/3266 |

FOREIGN PATENT DOCUMENTS

| | | | |
|---|---|---|---|
| CN | 104751789 | A | 7/2015 |
| CN | 104992674 | A | 10/2015 |
| CN | 106991976 | A | 7/2017 |
| CN | 207474026 | U | 6/2018 |

* cited by examiner

PIXEL CIRCUIT, DRIVING METHOD THEREOF AND DISPLAY DEVICE

CROSS REFERENCE

This application is a continuation of International Application No. PCT/CN2018/092164, filed on Jun. 21, 2018, which claims priority to Chinese Patent Application No. 201721426901.2, entitled "PIXEL CIRCUIT, DRIVING METHOD THEREOF AND DISPLAY DEVICE" filed on Oct. 31, 2017, the contents of which are expressly incorporated by reference herein in their entireties.

TECHNICAL FIELD

The disclosure relates to the field of display technology, and more particularly to a pixel circuit and a driving method thereof, a display device.

BACKGROUND

An organic light-emitting display device is a display device in which an organic light-emitting diode is used as a light-emitting component, and has characteristics of high contrast, thin thickness, wide viewing angle, fast response speed, low power consumption, etc., and is increasingly applied to various fields of display and illumination.

In the organic light-emitting display devices, a plurality of pixel circuits may be generally included. The plurality of pixel circuits are generally supplied with power supply voltages from the same power supply. The power supply voltage can determine a current flowing through the light-emitting diode in the pixel circuit.

However, in practical applications, when the power supply voltage is transmitted between the plurality of pixel circuits, an power supply voltage drop (IR drop) is inevitably generated, resulting in different actual power supply voltages acting on each pixel circuit, and further resulting in different currents flowing through each light-emitting diode and uneven display luminance of the display device.

SUMMARY

The main purpose of the disclosure is to provide a pixel circuit and a driving method thereof, a display device, which aim at solving the problem of the uneven display luminance of the display device due to different currents flowing through light-emitting diodes caused by a power supply voltage drop in the display devices.

In order to achieve the above purpose, the disclosure provides a pixel circuit comprising: a first thin film transistor, a second thin film transistor, a third thin film transistor, a fourth thin film transistor, a fifth thin film transistor, a sixth thin film transistor, a light-emitting diode and a storage capacitor. A gate of the first thin film transistor is separately connected to a source of the second thin film transistor. A source of the third thin film transistor and one end of the storage capacitor, a drain of the third thin film transistor is separately connected to a drain of the fifth thin film transistor and a reference voltage signal line. The other end of the storage capacitor is separately connected to a drain of the fourth thin film transistor and a source of the fifth thin film transistor, and a source of the fourth thin film transistor is connected to a data signal line. A source of the first thin film transistor is connected to a first power source. A drain of the first thin film transistor is separately connected to a drain of the second thin film transistor and a source of the sixth thin film transistor. A drain of the sixth thin film transistor is connected to an anode of the light-emitting diode, and a cathode of the light-emitting diode is connected to a second power source.

Optionally, the first power source provides a power supply voltage for the first thin film transistor; a current flows into the second power source when the light-emitting diode emits light.

Optionally, the reference voltage signal line provides a reference voltage, and the reference voltage is a negative voltage and initializes the gate of the first thin film transistor and one end of the storage capacitor; the data signal line provide a data voltage.

Optionally, a gate of the third thin film transistor is connected to a first scan line, the first scan line provides a first scan signal and the first scan signal controls the third thin film transistor to make the third thin film transistor set in an on-state or an off-state. A gate of the fourth thin film transistor is connected to a second scan line, the second scan line provides a second scan signal, and the second scan signal controls the fourth thin film transistor to make the fourth thin film transistor set in the on-state or the off-state. A gate of the second thin film transistor and a gate of the fifth thin film transistor are connected to a third scan line, the third scan line provides a third scan signal, and the third scan signal controls the second thin film transistor and the fifth thin film transistor to make the second thin film transistor and the fifth thin film transistor set in the on-state or the off-state. A gate of the sixth thin film transistor is connected to a first light-emitting control line, the first light-emitting control line provides a first light-emitting control signal, and the first light-emitting control signal controls the sixth thin film transistor to make the sixth thin film transistor set in the on-state or the off-state.

Optionally, when the first scan signal controls the third thin film transistor to make the third thin film transistor set in the on-state, the reference voltage signal line is connected to the gate of the first thin film transistor and the one end of the storage capacitor, and the reference voltage initializes the gate of the first thin film transistor and the one end of the storage capacitor. When the second scan signal controls the fourth thin film transistor to make the fourth thin film transistor set in the on-state, the data signal line is connected to the other end of the storage capacitor, and the data voltage is inputted into the pixel circuit via the storage capacitor. When the third scan signal controls the second thin film transistor and the fifth thin film transistor to make the second thin film transistor and the fifth thin film transistor set in the on-state, the gate of the first thin film transistor is connected to the drain thereof to compensate a threshold voltage of the first thin film transistor, the reference voltage signal line is connected to the other end of the storage capacitor and initializes the other end of the storage capacitor. When the first light-emitting control signal controls the sixth thin film transistor to make the sixth thin film transistor set in the on-state, a current flows through the light-emitting diode, and the current is independent of the first power source.

Optionally, the pixel circuit further comprises a seventh thin film transistor, a source of the seventh thin film transistor is connected to the first power source, a drain of the seventh thin film transistor is connected to the source of the first thin film transistor, and a gate of the seventh thin film transistor is connected to a second light-emitting control line. The second light-emitting control line provides a second light-emitting control signal, and when the second light-emitting control signal controls the seventh thin film transistor to make the seventh thin film transistor set in the on-state, the first power source is connected to the source of the first thin film transistor, and the first power source applies a voltage to the source of the first thin film transistor.

Optionally, the pixel circuit further comprises an eighth thin film transistor, a source of the eighth thin film transistor is connected to the reference voltage signal line, a drain of the eighth thin film transistor is connected to the anode of the light-emitting diode, a gate of the eighth thin film transistor is connected to a fourth scan line, and when a fourth scan signal controls the eighth thin film transistor to make the eighth thin film transistor set in the on-state, the reference voltage initializes the anode of the light-emitting diode.

Optionally, the first thin film transistor is a drive thin film transistor, and the first thin film transistor is a P-type thin film transistor; the second thin film transistor, the third thin film transistor, the fourth thin film transistor, the fifth thin film transistor, and the sixth thin film transistor are independently N-type thin film transistors or P-type thin film transistors.

Optionally, the seventh thin film transistor is a N-type thin film transistor or a P-type thin film transistor.

Optionally, the eighth thin film transistor is a N-type thin film transistor or a P-type thin film transistor.

The disclosure also provides a pixel circuit driving method, the driving method is used for driving the pixel circuit recorded above, comprising: in a first stage, controlling the third thin film transistor to change the third thin film transistor from the off-state to the on-state by the first scan signal, and initializing the gate of the first thin film transistor and the one end of the storage capacitor by the reference voltage, controlling the fourth thin film transistor to make the fourth thin film transistor set in the off-state by the second scan signal, controlling the second thin film transistor and the fifth thin film transistor to make the second thin film transistor and the fifth thin film transistor set in off-state by the third scan signal, and controlling the sixth thin film transistor to change the sixth thin film transistor from the on-state to the off-state by the first light-emitting control signal; in a second stage, controlling the third thin film transistor to change the third thin film transistor from the on-state to the off-state by the first scan signal, controlling the fourth thin film transistor to make the fourth thin film transistor set in the off-state by the second scan signal, and controlling the second thin film transistor and the fifth thin film transistor to change the second thin film transistor and the fifth thin film transistor from the off-state to the on-state to compensate for the threshold voltage of the first thin film transistor by the third scan signal, and controlling the sixth thin film transistor to make the sixth thin film transistor set in the off-state by the first light-emitting control signal; in a third stage, controlling the third thin film transistor to make the third thin film transistor set in the off-state by the first scan signal, and controlling the fourth thin film transistor to change the fourth thin film transistor from the off-state to the on-state by the second scan signal, applying a voltage to the other end of the storage capacitor by a data voltage, controlling the second thin film transistor and the fifth thin film transistor to change the second thin film transistor and the fifth thin film transistor from the on-state to the off-state by the third scan signal, and controlling the sixth thin film transistor to make the sixth thin film transistor set in the off-state by the first light-emitting control signal; in a fourth stage, controlling the third thin film transistor to make the third thin film transistor set in the off-state by the first scan signal, controlling the fourth thin film transistor to change the fourth thin film transistor from the on-state to the off-state by the second scan signal, controlling the second thin film transistor and the fifth thin film transistor to make the second thin film transistor and the fifth thin film transistor set in the off-state by the third scan signal, controlling the sixth thin film transistor to change the sixth thin film transistor from the off-state to the on-state by the first light-emitting control signal, and emitting light by the light-emitting diode.

Optionally, in the first stage, the voltage of one end of the storage capacitor and the gate voltage of the first thin film transistor are both Vref, and Vref is the reference voltage.

Optionally, in the second stage, the gate of the first thin film transistor is connected to the drain thereof, and the first power source applies a voltage to the source of the first thin film transistor to make the voltage of the gate of the first thin film transistor be VDD-Vth, and the threshold voltage of the first thin film transistor is compensated, wherein Vth is the threshold voltage of the first thin film transistor, and VDD is the first power supply.

Optionally, in the third stage, the voltage of the other end of the storage capacitor changes from Vref to Vdata, and the gate voltage of the first thin film transistor is VDD−Vth+Vdata−Vref under the action of the storage capacitor, so that in the fourth stage, the current flowing through the light-emitting diode is independent of the first power source, wherein Vdata is the data voltage.

Optionally, when the pixel circuit comprises the seventh thin film transistor, and the source of the seventh thin film transistor is connected to the first power source, the drain of the seventh thin film transistor is connected to the source of the first thin film transistor and a gate of the seventh thin film transistor is connected to the second light-emitting control line. The driving method further comprises: in the first stage, the second light-emitting control signal provided by the second light-emitting control line controls the seventh thin film transistor to change the seventh thin film transistor from the on-state to the off-state; in the second stage, the second light-emitting control signal controls the seventh thin film transistor to change the seventh thin film transistor from the off-state to the on-state; in the third stage, the second light-emitting control signal controls the seventh thin film transistor to change the seventh thin film transistor from the on-state to the off-state; in the fourth stage, the second light-emitting control signal controls the seventh thin film transistor to change the seventh thin film transistor from the off-state to the on-state.

Optionally, when the pixel circuit comprises the eighth thin film transistor, the source of the eighth thin film transistor is connected to the reference voltage signal line, the drain of the eighth thin film transistor is connected to the anode of the light-emitting diode and the gate of the eighth thin film transistor is connected to the fourth scan line. The driving method further comprises: in the first stage, the fourth scan signal provided by the fourth scan line controls the eighth thin film transistor to change the eighth thin film transistor from the off-state to the on-state; in the second stage, the fourth scan signal controls the eighth thin film transistor to change the eighth thin film transistor from the on-state to the off-state; in the third stage, the fourth scan signal controls the eighth thin film transistor to make the eighth thin film transistor set in the off-state; in the fourth stage, the fourth scan signal controls the eighth thin film transistor to make the eighth thin film transistor set in the off-state.

An embodiment of the disclosure also provides a display device, comprising the pixel circuit recorded above.

The following beneficial effects can be achieved by at least one of the above technical solutions adopted by the embodiments of the disclosure:

The pixel circuit provided by the embodiments of the disclosure includes six thin film transistors, one storage capacitor and one light-emitting diode. The pixel circuit can achieve the compensation for the power supply voltage during the light-emitting stage of the light-emitting diode so that the current flowing through the light-emitting diode is related to the data voltage and the reference voltage input into the pixel circuit, and is independent of the power voltage, thereby effectively avoiding the problem of the uneven display of the display device due to different currents flowing through the light-emitting diodes caused by a power supply voltage drop.

In addition, the pixel circuit provided by the embodiments of the disclosure can further compensate for the threshold voltage of a drive thin film transistor, thereby effectively avoiding the problem of the uneven display of the display device due to different threshold voltages of drive thin film transistors.

DETAILED DESCRIPTION OF PREFERRED EMBODIMENTS

The technical solutions of the disclosure will be clearly and completely described below in conjunction with the specific embodiments of the disclosure and the corresponding drawings.

It should be noted that in the pixel circuit provided by embodiments of the disclosure, a first thin film transistor is a drive thin film transistor, specifically, a P-type thin film transistor; a second thin film transistor, a third thin film transistor, a fourth thin film transistor, a fifth thin film transistor, a sixth thin film transistor, a seventh thin film transistor and an eighth thin film transistor may all be a P-type thin film transistor or N-type thin film transistor, and alternatively, at least one of them may be the P-type thin film transistor and the remaining ones are the N-type thin film transistors, and the embodiments of the disclosure are not specifically limited.

In the embodiments of the disclosure, as for different types of thin film transistors, scan signals provided by different scan lines may be different. The embodiments of the disclosure are described by taking the first thin film transistor through the eighth thin film transistor all being the P-type thin film transistors for example.

The light-emitting diode may be an LED or an OLED, and is not specifically limited herein. The embodiments of the disclosure may be described by taking the OLED as the light-emitting diode for example.

Technical solutions provided by the embodiments of the disclosure are described in detail below with reference to the accompanying drawings.

Figure 1:
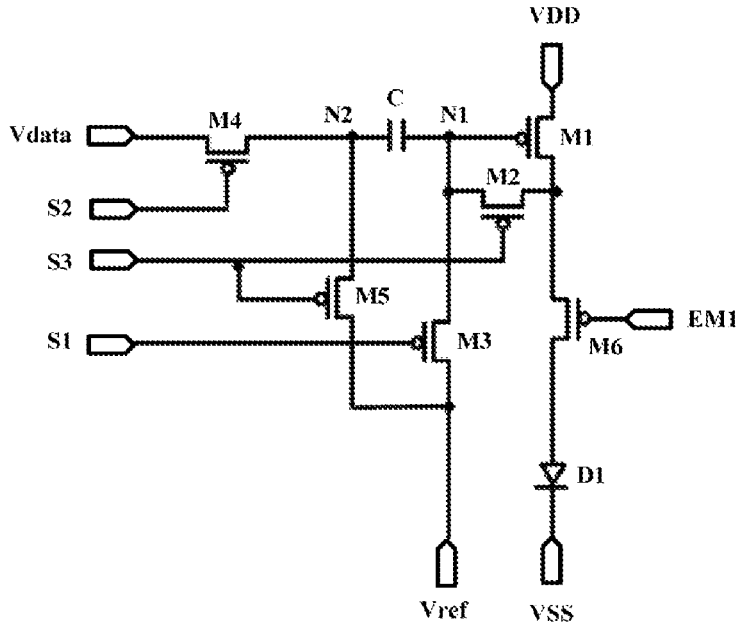
FIG. 1 is a schematic structural view of a pixel circuit provided by an embodiment of the disclosure.

FIG. 1 is a schematic structural view of a pixel circuit provided by an embodiment of the disclosure. The pixel circuit is as follows.

As shown in FIG. 1, the pixel circuit includes a first thin film transistor M1, a second thin film transistor M2, a third thin film transistor M3, a fourth thin film transistor M4, a fifth thin film transistor M5, a sixth thin film transistor M6, a storage capacitor C and a light-emitting diode D1.

In the pixel circuit shown in FIG. 1, the first thin film transistor M1, the second thin film transistor M2, the third thin film transistor M3, the fourth thin film transistor M4, the fifth thin film transistor M5 and the sixth thin film transistor M6 are all P-type thin film transistors, and the light-emitting diode D1 is an OLED.

In the pixel circuit shown in FIG. 1, a gate of the first thin film transistor M1 is separately connected to a source of the second thin film transistor M2, a source of the third thin film transistor M3 and one end of the storage capacitor C (the point N1 shown in FIG. 1). A source of the first thin film transistor M1 is connected to a first power supply VDD. A drain of the first thin film transistor M1 is separately connected to a drain of the second thin film transistor M2 and a source of the sixth thin film transistor M6. A drain of the third thin film transistor M3 is separately connected to a drain of the fifth thin film transistor M5 and a reference voltage signal line. A source of the fourth thin film transistor M4 is connected to a data signal line, and a drain of the fourth thin film transistor M4 is separately connected to a source of the fifth thin film transistor M5 and the other end of the storage capacitor C (the point N2 shown in FIG. 1). A drain of the sixth thin film transistor M6 is connected to an anode of the light-emitting diode D1. A cathode of the light-emitting diode D1 is connected to a second power source VSS.

In the embodiment of the disclosure, the first power source VDD may be a positive voltage, and is used to provide a power supply voltage for the first thin film transistor M1. The first thin film transistor M1 may output a current under the action of the first power source VDD. The current flowing into the light-emitting diode D1 causes the light-emitting diode D1 to emit light. When the light-emitting diode D1 emits light, the current flows into the second power source VSS. The second power source VSS may be a negative voltage.

A data voltage signal line can be used to provide a data voltage Vdata and the reference voltage signal line can be used to provide a reference voltage Vref. In the embodiment of the disclosure, the reference voltage Vref may be a negative voltage, and be used to initialize the gate of the first thin film transistor M1 and the one end of the storage capacitor C (the point N1 in FIG. 1).

In the pixel circuit shown in FIG. 1, S1 is a first scan signal provided by a first scan line, S2 is a second scan signal provided by a second scan line, S3 is a third scan signal provided by a third scan line, and EM1 is a first light-emitting control signal provided by a first light-emitting control line. A gate of the third thin film transistor M3 is connected to the first scan line, and the first scan signal S1 provided by the first scan line can control the third thin film transistor M3 to make the third thin film transistor set in an on-state or an off-state. A gate of the fourth thin film transistor M4 is connected to the second scan line, and the second scan signal S2 provided by the second scan line can control the fourth thin film transistor M4 to make the fourth thin film transistor set in the on-state or the off-state. A gate of the second thin film transistor M2 and a gate of the fifth thin film transistor M5 are connected to the third scan line. The third scan signal S3 provided by the third scan line can control the second thin film transistor M2 and the fifth thin film transistor M5 to make the second thin film transistor M2 and the fifth thin film transistor M5 set in the on-state or the off-state. A gate of the sixth thin film transistor M6 is connected to the first light-emitting control line, and the first light-emitting control signal EM1 provided by the first light-emitting control line can control the sixth thin film transistor M6 to make it in the on-state or the off-state.

In the embodiment of the disclosure, when the first scan signal S1 controls the third thin film transistor M3 to make the third thin film transistor M3 set in the on-state, the reference voltage line is connected to the gate of the first thin film transistor M1 and the one end point N1 of the storage capacitor C via the third thin film transistor M3. The reference voltage Vref can apply a voltage to the gate of the first thin film transistor M1 and the one end point N1 of the storage capacitor C (i.e., the right plate of the storage capacitor C), so that both the gate voltage of the first thin film transistor M1 and the voltage of the right plate of the storage capacitor C are Vref, and the initialization of the gate of the first thin film transistor M1 and the right plate of the storage capacitor C can be realized.

When the third scan signal S3 controls the second thin film transistor M2 and the fifth thin film transistor M5 to make the second thin film transistor M2 and the fifth thin film transistor M5 set in the on-state, as for the storage capacitor C, the reference voltage signal line is connected to the other end point N2 of the storage capacitor C via the fifth thin film transistor M5. The reference voltage Vref applies a voltage to the left plate of the storage capacitor C (the point N2 shown in FIG. 1), so that the voltage of the left plate of the storage capacitor C is Vref, and the initialization of the left plate of the storage capacitor C can be realized. As for the first thin film transistor M1, the gate of the first thin film transistor M1 is connected to the drain thereof, and the first power supply VDD acts on the gate of the first thin film transistor M1 via the source and the drain of the first thin film transistor M1, and charges the gate of the first thin film transistor M1. After the circuit is stabilized, the voltages of the gate and the drain of the first thin film transistor M1 are both VDD-Vth, so that in the light-emitting stage of the light-emitting diode D1, the threshold voltage of the first thin film transistor M1 can be compensated, wherein Vth is the threshold voltage of the first thin film transistor M1. When the second scan signal S2 controls the fourth thin film transistor M4 to make the fourth thin film transistor M4 set in the on-state, the data signal line is connected to the other end point N2 of the storage capacitor C via the fourth thin film transistor M4. At this time, the data voltage Vdata applies a voltage to the left plate (the point N2 shown in FIG. 1) of the storage capacitor C so as to input into the pixel circuit. When the first light-emitting control signal EM1 controls the sixth thin film transistor M6 to make the sixth thin film transistor M6 set in the on-state, the current generated by the first thin film transistor M1 may flow through the light-emitting diode D1, so that the light-emitting diode D1 emits light. The pixel circuit provided by the embodiment of the disclosure can compensate for the power supply voltage provided by the first power source VDD, so that the current is independent of the first power source VDD when the current flows through the light-emitting diode D1. In this way, the influence of the power supply voltage drop generated by the first power source VDD on the display evenness of the display device can be avoided.

Figure 2:
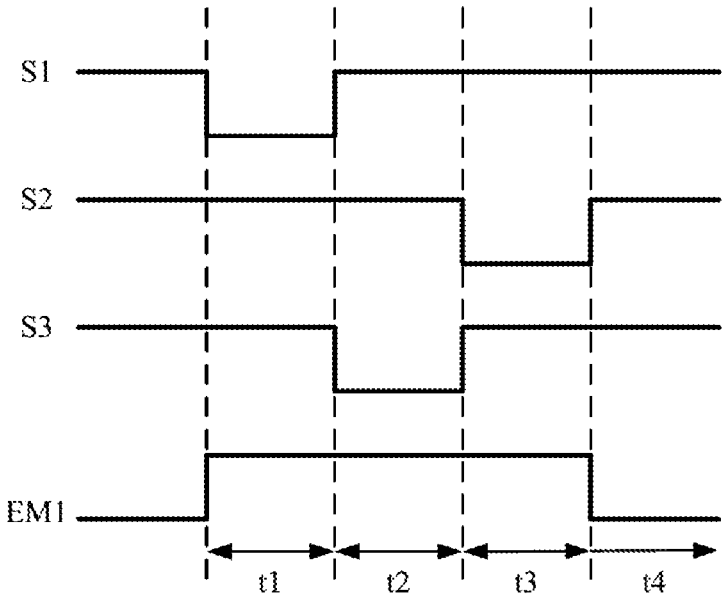
FIG. 2 is a timing view of a driving method for a pixel circuit provided by an embodiment of the disclosure.

FIG. 2 is a timing view of a driving method of a pixel circuit provided by an embodiment of the disclosure. The timing view of the driving method of the pixel circuit shown in FIG. 2 may be used to drive a pixel circuit shown in FIG. 1.

Specifically, when the timing view shown in FIG. 2 drives the pixel circuit shown in FIG. 1, the working cycle may include four stages: a first stage t1, a second stage t2, a third stage t3 and a fourth stage t4.

The following explains the above four stages separately:

For the first stage t1: since the first scan signal S1 changes from a high level to a low level, the second scan signal S2 maintains at the high level and the first light-emitting control signal EM1 changes from the low level to the high level, the third thin film transistor M3 changes from the off-state to the on-state, the fourth thin film transistor M4 is in the off-state, the second thin film transistor M2 and the fifth thin film transistor M5 are in the off-state and the sixth thin film transistor M6 changes from the on-state to the off-state.

The reference voltage Vref applies a voltage to the gate of the first thin film transistor M1 and the right plate of the storage capacitor C (the point N1 shown in FIG. 1) via the third thin film transistor M3, so that the gate voltage of the first thin film transistor M1 and the voltage of the right plate of the storage capacitor C are both Vref, that is, the reference voltage Vref initializes the gate of the first thin film transistor M1 and the right plate of the storage capacitor C.

For the second stage t2: since the first scan signal S1 changes from the low level to the high level, the second scan signal S2 maintains at the high level, the third scan signal S3 changes from the high level to the low level and the first light-emitting control signal EM1 maintains at the high level, the third thin film transistor M3 changes from the on-state to the off-state, the fourth thin film transistor M4 is in the off-state, the second thin film transistor M2 and the fifth thin film transistor M5 change from the off-state to the on-state and the sixth thin film transistor M6 still maintains in the off-state.

At this time, the gate of the first thin film transistor M1 is connected to the drain thereof, the first power source VDD charges the gate of the first thin film transistor M1. After the circuit is stabilized, the gate voltage and the drain voltage of the first thin film transistor M1 are both VDD-Vth, wherein Vth is the threshold voltage of the first thin film transistor M1. At the same time, the reference voltage Vref applies a voltage to the left plate of the storage capacitor C (the point N2 shown in FIG. 5) via the fifth thin film transistor M5, so that the voltage of the left plate of the storage capacitor C is Vref, and the left plate of the storage capacitor C is initialized.

In the second stage t2, the voltage of the right plate of the storage capacitor C is equal to the gate voltage of the first thin film transistor M1, that is, VDD−Vth.

For the third stage t3: since the first scan signal S1 maintains at the high level, the second scan signal S2 changes from the high level to the low level, the third scan signal S3 changes from the low level to the high level and the first light-emitting control signal EM1 maintains at the high level, the third thin film transistor M3 maintains in the off-state, the fourth thin film transistor M4 changes from the off-state to the on-state, the second thin film transistor M2 and the fifth thin film transistor M5 change from the on-state to the off-state and the sixth thin film transistor M6 is still in the off-state.

At this time, the data voltage Vdata applies a voltage to the left plate of the storage capacitor C (the point N2 in FIG. 5), so that the voltage of the left plate of the storage capacitor C changes from Vref to Vdata. Accordingly, the voltage of the right plate of the storage capacitor C (the point N1 shown in FIG. 5) changes from VDD−Vth to VDD−Vth+Vdata−Vref, that is, the voltage of the gate of the first thin film transistor M1 also changes from VDD−Vth to VDD−Vth+Vdata−Vref.

For the fourth stage t4: since the first scan signal S1 maintains at the high level, the second scan signal S2 changes from the low level to the high level, the third scan signal S3 maintains at the high level and the first light-emitting control signal EM1 changes from the high level to the low level, the third thin film transistor M3 is in the off-state, the fourth thin film transistor M4 changes from the on-state to the off-state, the second thin film transistor M2 and the fifth thin film transistor M5 are in the off-state and the sixth thin film transistor M6 changes from the off-state to the on-state.

At this time, under the action of the first power source VDD, the first thin film transistor M1 generates a driving current which flows into the light-emitting diode D1 via the sixth thin film transistor M6, so that the light-emitting diode D1 emits light. The current flowing through the light-emitting diode D1 can be expressed as:

$$I_{OLED} = \mu C_{ox}\frac{W}{2L}(V_{sg} - Vth)^2 = \mu C_{ox}\frac{W}{2L}(V_s - V_g - Vth)^2 = \mu C_{ox}\frac{W}{2L}(Vref - Vdata)^2$$

Wherein, μ is the electron mobility of the first thin film transistor M1, $C_{ox}$ is the gate oxide layer capacitance per unit area of the first thin film transistor M1, W/L is the aspect ratio of the first thin film transistor M1, Vs is source voltage VDD of the first thin film transistor M1 and Vg is the gate voltage VDD−Vth+Vdata−Vref of the first thin film transistor M1.

It can be seen from the above equation that the current flowing through the light-emitting diode D1 is related to the reference voltage Vref and the data voltage Vdata, and is independent of the first power supply voltage VDD, and is also independent of the threshold voltage Vth of the first thin film transistor M1. The compensation for the first power supply VDD can be achieved and the influence of the power supply voltage drop of the first power supply VDD on the display effect can be avoided, thereby ensuring the display evenness of the display device, and at the same time, the compensation for the threshold voltage of the first thin film transistor M1 can be achieved, thereby avoiding the problem of display unevenness of the display device caused by different threshold voltages of the first thin film transistor M1.

Figure 3:
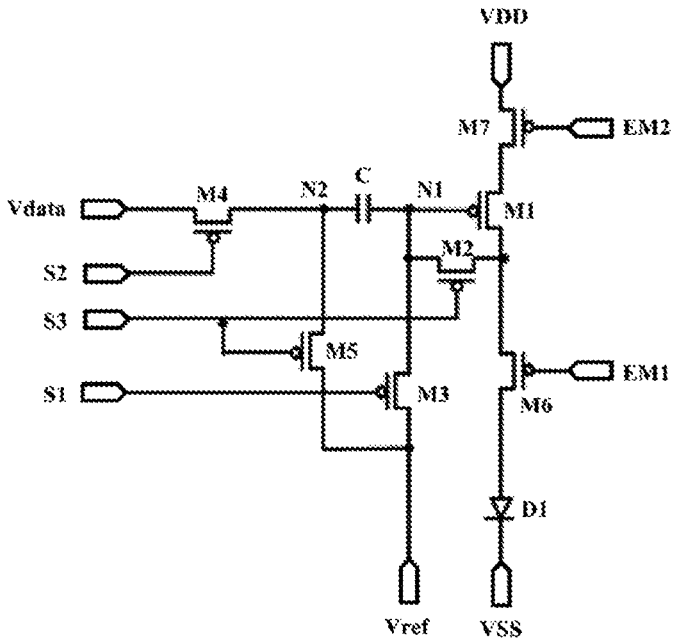
FIG. 3 is a schematic structural view of another pixel circuit provided by an embodiment of the disclosure.

As shown in FIG. 3, FIG. 3 is a schematic structural view of another pixel circuit provided by an embodiment of the disclosure. In comparison with FIG. 1, in FIG. 3, a seventh thin film transistor M7 is added, wherein the seventh thin film transistor M7 shown in FIG. 3 may be a P-type thin film transistor.

In FIG. 3, a source of the seventh thin film transistor M7 is connected to the first power source VDD, a drain of the seventh thin film transistor M7 is connected to the source of the first thin film transistor M1, and a gate of the seventh thin film transistor M7 is connected to the second light-emitting control line, and the second light-emitting control line is used to provide a second light-emitting control signal EM2 which is used to control the seventh thin film transistor M7 to make the seventh thin film transistor M7 in the on-state or off-state. When the second light-emitting control signal EM2 controls the seventh thin film transistor M7 to make the seventh thin film transistor M7 in the on-state, the first power supply VDD may be connected to the source of the first thin film transistor M1 via the seventh thin film transistor M7, and applies a voltage to the source of the first thin film transistor M1.

In the pixel circuit shown in FIG. 3, the first scan signal S1, the second scan signal S2, the third scan signal S3 and the first light-emitting control signal EM1 perform the same function in the pixel circuit as the first scan signal S1, the second scan signal S2, a third scan signal S3 and the first light-emitting control signal EM1 do in the pixel circuit shown in FIG. 1, which will not be repeatedly described here.

Figure 4:
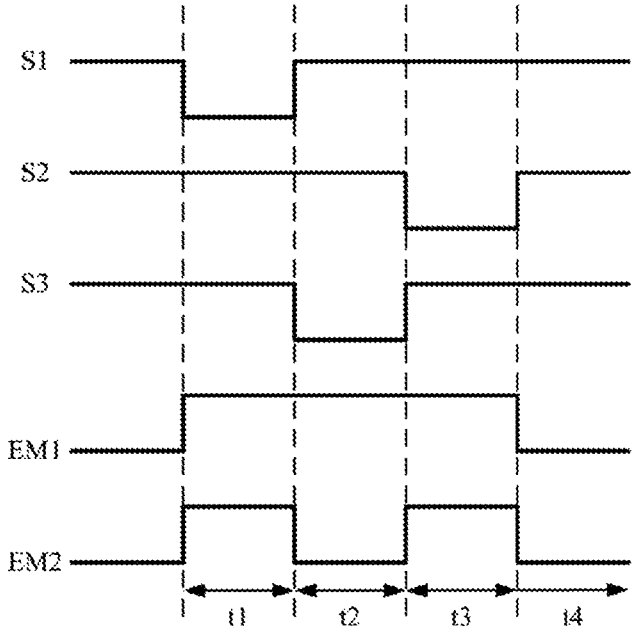
FIG. 4 is a timing view of a driving method for another pixel circuit provided by an embodiment of the disclosure.

FIG. 4 is a timing view of a driving method for another pixel circuit provided by an embodiment of the disclosure. The timing view of the driving method of the pixel circuit shown in FIG. 4 may be used to drive the pixel circuit shown in FIG. 3. Specifically: when the timing view shown in FIG. 4 drives the pixel circuit shown in FIG. 3, the working cycle may include four stages: a first stage t1, a second stage t2, a third stage t3 and a fourth stage t4.

The following explains the above four stages separately:

For the first stage t1: since the first scan signal S1 changes from a high level to a low level, the second scan signal S2 maintains at the high level, the third scan signal S3 maintains at the high level, the first light-emitting control signal EM1 changes from the high level to the low level and the second light-emitting control signal EM2 changes from the low level to the high level, the third thin film transistor M3 changes from an off-state to an on-state, the fourth thin film transistor M4 is in the off-state, the second thin film transistor M2 and the fifth thin film transistor M5 are in the off-state, the sixth thin film transistor M6 changes from the on-state to the off-state and the seventh thin film transistor M7 changes from the on-state to the off-state.

At this time, the reference voltage Vref applies a voltage to the gate of the first thin film transistor M1 and the right plate of the storage capacitor C (the point N1 shown in FIG. 3) via the third thin film transistor M3, so that the gate voltage of the first thin film transistor M1 and the voltage of the right plate of the storage capacitor C are both Vref, that is, the reference voltage Vref is used to achieve the initialization of the gate of the first thin film transistor M1 and the right plate of the storage capacitor C.

For the second stage t2: since the first scan signal S1 changes from the low level to the high level, the second scan signal S2 maintains at the high level, the third scan signal S3 changes from the high level to the low level, the first light-emitting control signal EM1 maintains at the high level and the second light-emitting control signal EM2 changes from the high level to the low level, the third thin film transistor M3 changes from the on-state to the off-state, the fourth thin film transistor M4 is in the off-state, the second thin film transistor M2 and the fifth thin film transistor M5 change from the off-state to the on-state, the sixth thin film transistor M6 still maintains in the off-state and the seventh thin film transistor M7 changes from the off-state to the on-state.

At this time, the gate of the first thin film transistor M1 is connected to the drain thereof, the first power source VDD applies a voltage to the source of the first thin film transistor M1 via the seventh thin film transistor M7, and charges the gate of the first thin film transistor M1 via the drain of the first thin film transistor M1. After the circuit is stabilized, the voltages of the gate and the drain of the first thin film transistor M1 are both VDD−Vth, wherein Vth is the threshold voltage of the first thin film transistor M1. At the same time, the reference voltage Vref applies a voltage to the left plate of the storage capacitor C (the point N2 shown in FIG. 3) via the fifth thin film transistor M5, so that the voltage of the left plate of the storage capacitor C is Vref, and the left plate of the storage capacitor C is initialized.

In the second stage t2, the voltage of the right plate of the storage capacitor C is equal to the voltage of the gate of the first thin film transistor M1, the voltage is, VDD−Vth.

For the third stage t3: since the first scan signal S1 maintains at the high level, the second scan signal S2 changes from the high level to the low level, the third scan signal S3 changes from the low level to the high level, the first light-emitting control signal EM1 maintains at the high level and the second light-emitting control signal EM2 changes from the low level to the high level, the third thin film transistor M3 maintains in the off-state, the fourth thin film transistor M4 changes from the off-state to the on-state, the second thin film transistor M2 and the fifth thin film transistor M5 change from the on-state to the off-state, the sixth thin film transistor M6 is still in the off-state and the seventh thin film transistor M7 changes from the on-state to the off-state.

At this time, the data voltage Vdata applies a voltage to the left plate of the storage capacitor C (the point N2 in FIG. 3), so that the voltage of the left plate of the storage capacitor C changes from Vref to Vdata. Accordingly, the voltage of the right plate of the storage capacitor C (the point N1 shown in FIG. 3) changes from VDD−Vth to VDD−Vth+Vdata−Vref, that is, the voltage of the gate of the first thin film transistor M1 also changes from VDD−Vth to VDD−Vth+Vdata−Vref.

For the fourth stage t4: since the first scan signal S1 maintains at the high level, the second scan signal S2 changes from the low level to the high level, the third scan signal S3 maintains at the high level, the first light-emitting control signal EM1 changes from the high level to the low level and the second light-emitting control signal EM2 changes from the high level to the low level, the third thin film transistor M3 is in the off-state, the fourth thin film transistor M4 changes from the on-state to the off-state, the second thin film transistor M2 and the fifth thin film transistor M5 are in the off-state, the sixth thin film transistor M6 changes from the off-state to the on-state and the seventh thin film transistor M7 changes from the off-state to the on-state.

At this time, the first power source VDD applies a voltage to the source of the first thin film transistor M1 via the seventh thin film transistor M7. Under the action of the first power source VDD, the first thin film transistor M1 generates a driving current which flows into the light-emitting diode D1 via the sixth thin film transistor M6, so that the light-emitting diode D1 emits light. Wherein, the current flowing through the light-emitting diode D1 can be expressed as:

$$I_{OLED} = \mu C_{ox}\frac{W}{2L}(V_{sg} - Vth)^2 =$$

-continued $$\mu C_{ox}\frac{W}{2L}(V_s - V_g - Vth)^2 = \mu C_{ox}\frac{W}{2L}(Vref - Vdata)^2$$

Wherein, μ is the electron mobility of the first thin film transistor M1, $C_{ox}$ is the gate oxide layer capacitance per unit area of the first thin film transistor M1, W/L is the aspect ratio of the first thin film transistor M1, Vs is source voltage of the first thin film transistor M1, i.e., VDD and Vg is the voltage of the gate of the first thin film transistor M1, i.e., VDD−Vth+Vdata−Vref.

It can be seen from the above equation that the current flowing through the light-emitting diode D1 is related to the reference voltage Vref and the data voltage Vdata, and is independent of the first power supply VDD, and is also independent of the threshold voltage Vth of the first thin film transistor M1. The compensation for the first power supply VDD can be achieved and the influence of the power supply voltage drop of the first power supply VDD on the display effect can be avoided, thereby ensuring the display evenness of the display device, and at the same time, the compensation for the threshold voltage of the first thin film transistor M1 can be achieved, thereby avoiding the problem of display unevenness of the display device caused by different threshold voltages of the first thin film transistor M1.

Figure 5:
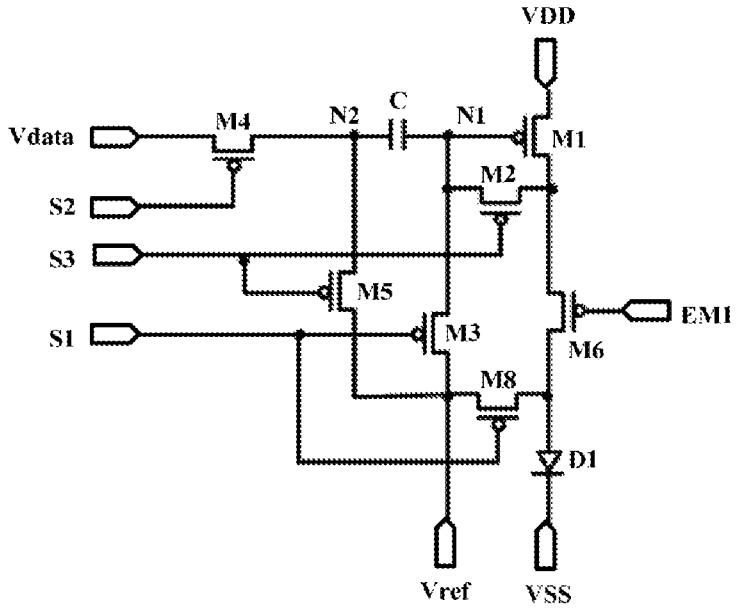
FIG. 5 is a schematic structural view of another pixel circuit provided by an embodiment of the disclosure.

As shown in FIG. 5, FIG. 5 is a schematic structural view of another pixel circuit provided by an embodiment of the disclosure. In comparison with FIG. 1, in FIG. 5, an eighth thin film transistor M8 is added, wherein the eighth thin film transistor M8 shown in FIG. 5 may be a P-type thin film transistor or a N-type thin film transistor.

In FIG. 5, a source of the eighth thin film transistor M8 is connected to a reference voltage signal line for providing a reference voltage Vref, a drain of the eighth thin film transistor M8 is connected to an anode of the light-emitting diode D1, and a gate of the eighth thin film transistor M8 is connected to a fourth scan line, and the fourth scan line can control the eighth thin film transistor to make the eighth thin film transistor in an on-state or an off-state.

It should be noted that a fourth scan signal provided by the fourth scan line may be the same as the first scan signal provided by the first scan line described in the embodiment shown in FIG. 1. In order to save space, the fourth scan line and the first scan line may be the same scan line. The following is described by replacing the fourth scan line with the first scan line.

The first scan signal S1 in FIG. 5 is used to control the third thin film transistor M3 and the eighth thin film transistor M8 to make the third thin film transistor M3 and the eighth thin film transistor M8 in the on-state or off-state. Wherein, when the first scan signal S1 controls the eighth thin film transistor M8 to make the eighth thin film transistor M8 in the on-state, the reference voltage Vref may be connected to the anode of the light-emitting diode D1 via the eighth thin film transistor M8, and initialize the light-emitting diode D1.

In the embodiment of the disclosure, the reference voltage Vref may be a negative voltage lower than a second power source VSS, thereby ensuring that the light-emitting diode D1 does not emit light when the reference voltage Vref initializes the anode of the light-emitting diode D1. Since the pixel circuit in the embodiment of the disclosure can initialize the anode of the light-emitting diode D1, the pixel circuit can display pure black in the non-light-emitting stage of the light-emitting diode D1, thereby improving the contrast of the display device.

In the pixel circuit shown in FIG. 5, the second scan signal S2, the third scan signal S3 and the first light-emitting control signal EM1 perform the same function in the pixel circuit as the second scan signal S2, the third scan signal S3 and the first light-emitting control signal EM1 do in the pixel circuit shown in FIG. 1, which will not be repeatedly described here.

Figure 6:
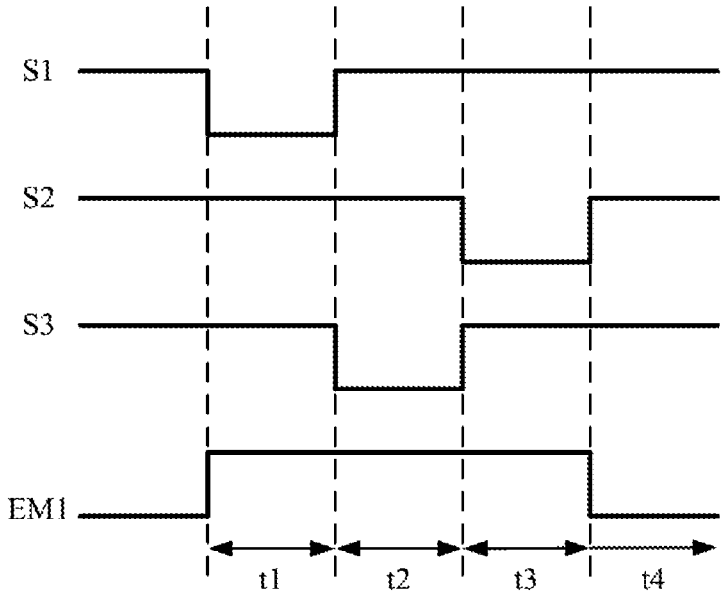
FIG. 6 is a timing view of a driving method for another pixel circuit provided by an embodiment of the disclosure.

FIG. 6 is a timing view of a driving method for another pixel circuit provided by an embodiment of the disclosure. The timing view of the driving method for the pixel circuit shown in FIG. 6 may be used to drive the pixel circuit shown in FIG. 5.

Specifically, when the timing view shown in FIG. 6 drives the pixel circuit shown in FIG. 5, the working cycle may include four stages: a first stage t1, a second stage t2, a third stage t3 and a fourth stage t4.

The following explains the above four stages separately:

For the first stage t1: since the first scan signal S1 changes from a high level to a low level, the second scan signal S2 maintains at the high level, the third scan signal S3 maintains at the high level and the first light-emitting control signal EM1 changes from the low level to the high level, the third thin film transistor M3 and the eighth thin film transistor M8 change from an off-state to an on-state, the fourth thin film transistor M4 is in the off-state, the second thin film transistor M2 and the fifth thin film transistor M5 are in the off-state and the sixth thin film transistor M6 changes from the on-state to the off-state.

At this time, the reference voltage Vref applies a voltage to the gate of the first thin film transistor M1 and the right plate of the storage capacitor C (the point N1 shown in FIG. 5) via the third thin film transistor M3, so that the voltage of the gate of the first thin film transistor M1 and the voltage of the right plate of the storage capacitor C are both Vref, that is, the reference voltage Vref initializes the gate of the first thin film transistor M1 and the right plate of the storage capacitor C.

At the same time, the reference voltage Vref applies a voltage to the anode of the light-emitting diode D1 via the eighth thin film transistor M8, so that the anode voltage of the light-emitting diode D1 becomes Vref. Since Vref can be a negative voltage lower than a second power source VSS, in the first stage t1, the light-emitting diode D1 does not emit light. In this way, the pixels can display pure dark in the non-light-emitting stage of the light-emitting diode D1, thereby improving the contrast of the display device.

For the second stage t2: since the first scan signal S1 changes from the low level to the high level, the second scan signal S2 maintains at the high level, the third scan signal S3 changes from the high level to the low level and the first light-emitting control signal EM1 maintains at the high level, the third thin film transistor M3 and the eighth thin film transistor M8 change from the on-state to the off-state, the fourth thin film transistor M4 is in the off-state, the second thin film transistor M2 and the fifth thin film transistor M5 change from the off-state to the on-state and the sixth thin film transistor M6 still maintains in the off-state.

At this time, the gate of the first thin film transistor M1 is connected to the drain of the first thin film transistor M1, the first power source VDD charges the gate of the first thin film transistor M1. After the circuit is stabilized, the voltages of the gate and the drain of the first thin film transistor M1 are both VDD−Vth, wherein Vth is the threshold voltage of the first thin film transistor M1. At the same time, the reference voltage Vref applies a voltage to the left plate of the storage capacitor C (the point N2 shown in FIG. 3) via the fifth thin film transistor M5, so that the voltage of the left plate of the storage capacitor C is Vref, and the left plate of the storage capacitor C is initialized.

In the second stage t2, the voltage of the right plate of the storage capacitor C is equal to the voltage of the gate of the first thin film transistor M1, that is, VDD−Vth.

For the third stage t3: since the first scan signal S1 maintains at the high level, the second scan signal S2 changes from the high level to the low level, the third scan signal S3 changes from the low level to the high level and the first light-emitting control signal EM1 maintains at the high level, the third thin film transistor M3 and the eighth thin film transistor M8 maintain in the off-state, the fourth thin film transistor M4 changes from the off-state to the on-state, the second thin film transistor M2 and the fifth thin film transistor M5 change from the on-state to the off-state and the sixth thin film transistor M6 is still in the off-state.

At this time, the data voltage Vdata applies a voltage to the left plate of the storage capacitor C (the point N2 in FIG. 5), so that the voltage of the left plate of the storage capacitor C changes from Vref to Vdata. Accordingly, the voltage of the right plate of the storage capacitor C (the point N1 shown in FIG. 5) changes from VDD−Vth to VDD−Vth+Vdata−Vref, that is, the voltage of the gate of the first thin film transistor M1 also changes from VDD−Vth to VDD−Vth+Vdata−Vref.

For the fourth stage t4: since the first scan signal S1 maintains at the high level, the second scan signal S2 changes from the low level to the high level, the third scan signal S3 maintains at the high level and the first light-emitting control signal EM1 changes from the high level to the low level, the third thin film transistor M3 and the eighth thin film transistor M8 are in the off-state, the fourth thin film transistor M4 changes from the on-state to the off-state, the second thin film transistor M2 and the fifth thin film transistor M5 are in the off-state and the sixth thin film transistor M6 changes from the off-state to the on-state.

At this time, under the action of the first power source VDD, the first thin film transistor M1 generates a driving current, the driving current flows into the light-emitting diode D1 via the sixth thin film transistor M6, so that the light-emitting diode D1 emits light. The current flowing through the light-emitting diode D1 can be expressed as:

$$I_{OLED} = \mu C_{ox}\frac{W}{2L}(V_{sg} - Vth)^2 = \mu C_{ox}\frac{W}{2L}(V_s - V_g - Vth)^2 = \mu C_{ox}\frac{W}{2L}(Vref - Vdata)^2$$

Wherein, μ is the electron mobility of the first thin film transistor M1, $C_{ox}$ is the gate oxide layer capacitance per unit area of the first thin film transistor M1, W/L is the aspect ratio of the first thin film transistor M1, Vs is source voltage of the first thin film transistor M1, i.e., VDD and Vg is the voltage of the gate of the first thin film transistor M1, i.e., VDD−Vth+Vdata−Vref.

It can be seen from the above equation that the current flowing through the light-emitting diode D1 is related to the reference voltage Vref and the data voltage Vdata, and is independent of the first power supply VDD, and is also independent of the threshold voltage Vth of the first thin film transistor M1. The compensation for the first power supply VDD can be achieved and the influence of the power supply voltage drop of the first power supply VDD on the display effect can be avoided, thereby ensuring the display evenness of the display device, and at the same time, the compensation for the threshold voltage of the first thin film transistor M1 can be achieved, thereby avoiding the problem of display unevenness of the display device caused by different threshold voltages of the first thin film transistor M1.

Figure 7:
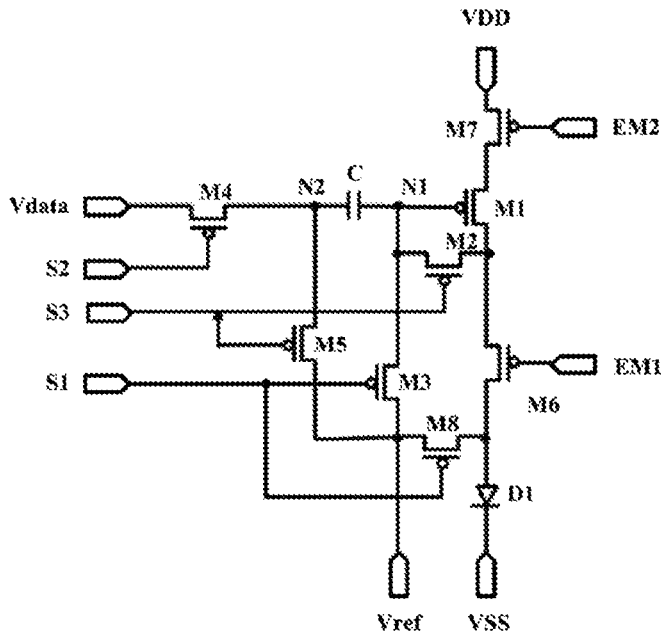
FIG. 7 is a schematic structural view of another pixel circuit provided by an embodiment of the disclosure.

As shown in FIG. 7, FIG. 7 is a schematic structural view of another pixel circuit provided by an embodiment of the disclosure. In comparison with FIG. 1, in FIG. 7, a seventh thin film transistor M7 and an eighth thin film transistor M8 are added. The connection structure of the seventh thin film transistor M7 may be the same as the connection structure of the seventh thin film transistor shown in FIG. 3. The connection structure of the eighth thin film transistor M8 may be the same as the connection structure of the eighth thin film transistor shown in FIG. 5, which will not be repeatedly described here. Wherein, the seventh thin film transistor M7 and the eighth thin film transistor M8 shown in FIG. 7 may both be P-type thin film transistors.

A first scan signal S1 in FIG. 7 is used to control the third thin film transistor M3 and the eighth thin film transistor M8 to make the third thin film transistor M3 and the eighth thin film transistor M8 in an on-state or an off-state. Wherein, when the first scan signal S1 controls the eighth thin film transistor M8 to make the eighth thin film transistor M8 in the on-state, the reference voltage Vref may be connected to an anode of the light-emitting diode D1 via the eighth thin film transistor M8, and initialize the light-emitting diode D1.

In the embodiment of the disclosure, the reference voltage Vref may be a negative voltage lower than a second power source VSS, thereby ensuring that the anode of the light-emitting diode D1 does not emit light when the reference voltage Vref initializes the anode of the light-emitting diode D1.

In the pixel circuit shown in FIG. 7, the second scan signal S2, the third scan signal S3 and the first light-emitting control signal EM1 perform the same function in the pixel circuit as the second scan signal S2, the third scan signal S3 and the first light-emitting control signal EM1 do in the pixel circuit shown in FIG. 3, which will not be repeatedly described here.

Figure 8:
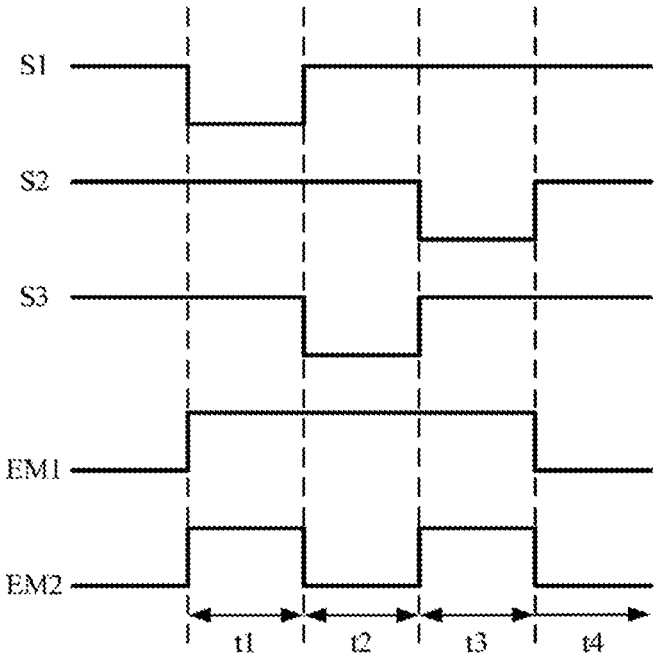
FIG. 8 is a timing view of a driving method for still another pixel circuit provided by an embodiment of the disclosure.

FIG. 8 is a timing view of a driving method for another pixel circuit provided by an embodiment of the disclosure. The timing view of the driving method for the pixel circuit shown in FIG. 8 may be used to drive the pixel circuit shown in FIG. 7. Specifically: when the timing view shown in FIG. 8 drives the pixel circuit shown in FIG. 7, the working cycle may include four stages: a first stage t1, a second stage t2, a third stage t3 and a fourth stage t4.

The following explains the above four stages separately:

For the first stage t1: since the first scan signal S1 changes from a high level to a low level, the second scan signal S2 maintains at the high level, the third scan signal S3 maintains at the high level, the first light-emitting control signal EM1 changes from the low level to the high level and the second light-emitting control signal EM2 changes from the low level to the high level, the third thin film transistor M3 and the eighth thin film transistor M8 changes from an off-state to an on-state, the fourth thin film transistor M4 is in the off-state, the second thin film transistor M2 and the fifth thin film transistor M5 are in the off-state, the sixth thin film transistor M6 changes from the on-state to the off-state and the seventh thin film transistor M7 changes from the on-state to the off-state.

At this time, the reference voltage Vref applies a voltage to the gate of the first thin film transistor M1 and the right plate of the storage capacitor C (the point N1 shown in FIG. 7) via the third thin film transistor M3, so that the voltage of the gate of the first thin film transistor M1 and the voltage of the right plate of the storage capacitor C are both Vref, that is, the reference voltage Vref initializes the gate of the first thin film transistor M1 and the right plate of the storage capacitor C.

At the same time, the reference voltage Vref applies a voltage to the anode of the light-emitting diode D1 via the eighth thin film transistor M8, so that an anode voltage of the light-emitting diode D1 becomes Vref. Since Vref may be a negative voltage lower than a second power source VSS, in the first stage t1, the light-emitting diode D1 does not emit light. In this way, the pixels can display pure dark in the non-light-emitting stage of the light-emitting diode D1, thereby improving the contrast of the display device.

For the second stage t2: since the first scan signal S1 changes from the low level to the high level, the second scan signal S2 maintains at the high level, the third scan signal S3 changes from the high level to the low level, the first light-emitting control signal EM1 maintains at the high level and the second light-emitting control signal EM2 changes from the high level to the low level, the third thin film transistor M3 and the eighth thin film transistor M8 change from the on-state to the off-state, the fourth thin film transistor M4 is in the off-state, the second thin film transistor M2 and the fifth thin film transistor M5 change from the off-state to the on-state, the sixth thin film transistor M6 still maintains in the off-state and the seventh thin film transistor M7 changes from the off-state to the on-state.

At this time, the gate of the first thin film transistor M1 is connected to the drain of the first thin film transistor M1, the first power source VDD applies a voltage to the source of the first thin film transistor M1 via the seventh thin film transistor M7, and charges the gate of the first thin film transistor M1 via the drain of the first thin film transistor M1. After the circuit is stabilized, the voltages of the gate and the drain of the first thin film transistor M1 are both VDD−Vth, wherein Vth is the threshold voltage of the first thin film transistor M1. At the same time, the reference voltage Vref applies a voltage to the left plate of the storage capacitor C (the point N2 shown in FIG. 7) via the fifth thin film transistor M5, so that the voltage of the left plate of the storage capacitor C is Vref, and the left plate of the storage capacitor C is initialized.

In the second stage t2, the voltage of the right plate of the storage capacitor C is equal to the voltage of the gate of the first thin film transistor M1, that is, VDD−Vth.

For the third stage t3: since the first scan signal S1 maintains at the high level, the second scan signal S2 changes from the high level to the low level, the third scan signal S3 changes from the low level to the high level, the first light-emitting control signal EM1 maintains at the high level and the second light-emitting control signal EM2 changed from the low level to the high level, the third thin film transistor M3 and the eighth thin film transistor M8 maintain in the off-state, the fourth thin film transistor M4 changes from the off-state to the on-state, the second thin film transistor M2 and the fifth thin film transistor M5 change from the on-state to the off-state, the sixth thin film transistor M6 is still in the off-state and the seventh thin film transistor M7 changes from the on-state to the off-state.

At this time, the data voltage Vdata applies a voltage to the left plate of the storage capacitor C (the point N2 in FIG. 7), so that the voltage of the left plate of the storage capacitor C changes from Vref to Vdata. Accordingly, the voltage of the right plate of the storage capacitor C (the point N1 shown in FIG. 7) changes from VDD−Vth to VDD−Vth+Vdata−

Vref, that is, the voltage of gate of the first thin film transistor M1 also changes from VDD−Vth to VDD−Vth+Vdata−Vref.

For the fourth stage t4: since the first scan signal S1 maintains at the high level, the second scan signal S2 changes from the low level to the high level, the third scan signal S3 maintains at the high level, the first light-emitting control signal EM1 changes from the high level to the low level and the second light-emitting control signal EM2 changes from the high level to the low level, the third thin film transistor M3 and the eighth thin film transistor M8 are in the off-state, the fourth thin film transistor M4 changes from the on-state to the off-state, the second thin film transistor M2 and the fifth thin film transistor M5 are in the off-state, the sixth thin film transistor M6 changes from the off-state to the on-state and the seventh thin film transistor M7 changes from the off-state to the on-state.

At this time, the first power source VDD applies a voltage to the source of the first thin film transistor M1 via the seventh thin film transistor M7. Under the action of the first power source VDD, the first thin film transistor M1 generates a drive current which flows into the light-emitting diode D1 via the sixth thin film transistor M6, so that the light-emitting diode D1 emits light. The current flowing through the light-emitting diode D1 can be expressed as:

$$I_{OLED} = \mu C_{ox}\frac{W}{2L}(V_{sg} - Vth)^2 = \mu C_{ox}\frac{W}{2L}(V_s - V_g - Vth)^2 = \mu C_{ox}\frac{W}{2L}(Vref - Vdata)^2$$

Wherein, μ is the electron mobility of the first thin film transistor M1, $C_{ox}$ is the gate oxide layer capacitance per unit area of the first thin film transistor M1, W/L is the aspect ratio of the first thin film transistor M1, Vs is source voltage of the first thin film transistor M1, i.e., VDD and Vg is the gate voltage of the first thin film transistor M1, i.e., VDD−Vth+Vdata−Vref.

It can be seen from the above equation that the current flowing through the light-emitting diode D1 is related to the reference voltage Vref and the data voltage Vdata, and is independent of the first power supply VDD, and is also independent of the threshold voltage Vth of the first thin film transistor M1. The compensation for the first power supply VDD can be achieved and the influence of the power supply voltage drop of the first power supply VDD on the display effect can be avoided, thereby ensuring the display evenness of the display device, and at the same time, the compensation for the threshold voltage of the first thin film transistor M1 can be achieved, thereby avoiding the problem of display unevenness of the display device caused by different threshold voltages of the first thin film transistor M1.

The embodiment of the disclosure further provides a display device which may include the pixel circuit described above.

It is apparent that a person skilled in the art can make various modifications and variations to the disclosure without departing from the scope of the disclosure. Thus, if such modifications and variations of the disclosure are within the scope of the claims of the disclosure and the technical equivalents thereof, the disclosure is also intended to include such modifications and variations.

What is claimed is:

1. A pixel circuit, comprising:

a first thin film transistor, a second thin film transistor, a third thin film transistor, a fourth thin film transistor, a fifth thin film transistor, a sixth thin film transistor, a light-emitting diode and a storage capacitor, wherein, a gate of the first thin film transistor is separately connected to a source of the second thin film transistor, a source of the third thin film transistor and one end of the storage capacitor, a drain of the third thin film transistor is separately connected to a drain of the fifth thin film transistor and a reference voltage signal line, the other end of the storage capacitor is separately connected to a drain of the fourth thin film transistor and a source of the fifth thin film transistor, and a source of the fourth thin film transistor is connected to a data signal line;

a source of the first thin film transistor is connected to a first power source; and a drain of the first thin film transistor is separately connected to a drain of the second thin film transistor and a source of the sixth thin film transistor, a drain of the sixth thin film transistor is connected to an anode of the light-emitting diode, and a cathode of the light-emitting diode is connected to a second power source, wherein the reference voltage signal line provides a reference voltage, and the reference voltage is a negative voltage and initializes the gate of the first thin film transistor and one end of the storage capacitor, and the data signal line provides a data voltage, wherein a gate of the third thin film transistor is connected to a first scan line, the first scan line provides a first scan signal and the first scan signal controls the third thin film transistor to make the third thin film transistor set in an on-state or an off-state, a gate of the fourth thin film transistor is connected to a second scan line, the second scan line provides a second scan signal, and the second scan signal controls the fourth thin film transistor to make the fourth thin film transistor set in the on-state or the off-state, a gate of the second thin film transistor and a gate of the fifth thin film transistor are connected to a third scan line, the third scan line provides a third scan signal, and the third scan signal controls the second thin film transistor and the fifth thin film transistor to make the second thin film transistor and the fifth thin film transistor set in the on-state or the off-state, and a gate of the sixth thin film transistor is connected to a first light-emitting control line, the first light-emitting control line provides a first light-emitting control signal, and the first light-emitting control signal controls the sixth thin film transistor to make the sixth thin film transistor set in the on-state or the off-state.

2. The pixel circuit according to claim 1, wherein the first power source provides a power supply voltage for the first thin film transistor; and a current flows into the second power source when the light-emitting diode emits light.

3. The pixel circuit according to claim 1, wherein when the first scan signal controls the third thin film transistor to make the third thin film transistor set in the on-state, the reference voltage signal line is connected to the gate of the first thin film transistor and one end of the storage capacitor, and the reference voltage initializes the gate of the first thin film transistor and the one end of the storage capacitor;

when the second scan signal controls the fourth thin film transistor to make the fourth thin film transistor set in the on-state, the data signal line is connected to the other end of the storage capacitor, and the data voltage is input into the pixel circuit via the storage capacitor;

when the third scan signal controls the second thin film transistor and the fifth thin film transistor to make the second thin film transistor and the fifth thin film transistor set in the on-state, the gate of the first thin film transistor is connected to the drain of the first thin film transistor, a threshold voltage of the first thin film transistor is compensated, the reference voltage signal line is connected to the other end of the storage capacitor and initializes the other end of the storage capacitor; and when the first light-emitting control signal controls the sixth thin film transistor to make the sixth thin film transistor set in the on-state, a current flows through the light-emitting diode, and the current is independent of the first power source.

4. The pixel circuit according to claim 1, wherein the pixel circuit further comprises a seventh thin film transistor, a source of the seventh thin film transistor is connected to the first power source, a drain of the seventh thin film transistor is connected to the source of the first thin film transistor, and a gate of the seventh thin film transistor is connected to a second light-emitting control line; and the second light-emitting control line provides a second light-emitting control signal, and when the second light-emitting control signal controls the seventh thin film transistor to make the seventh thin film transistor in the on-state, the first power source is connected to the source of the first thin film transistor, and the first power source applies a voltage to the source of the first thin film transistor.

5. The pixel circuit according to claim 4, wherein the seventh thin film transistor is a N-type thin film transistor or a P-type thin film transistor.

6. The pixel circuit according to claim 1, wherein the pixel circuit further comprises an eighth thin film transistor, a source of the eighth thin film transistor is connected to the reference voltage signal line, a drain of the eighth thin film transistor is connected to the anode of the light-emitting diode, a gate of the eighth thin film transistor is connected to a fourth scan line, and when a fourth scan signal controls the eighth thin film transistor to make the eighth thin film transistor in the on-state, the reference voltage initializes the anode of the light-emitting diode.

7. The pixel circuit according to claim 6, wherein the eighth thin film transistor is a N-type thin film transistor or a P-type thin film transistor.

8. The pixel circuit according to claim 1, wherein the first thin film transistor is a drive thin film transistor, and the first thin film transistor is a P-type thin film transistor; and the second thin film transistor, the third thin film transistor, the fourth thin film transistor, the fifth thin film transistor, and the sixth thin film transistor are independently N-type thin film transistors or P-type thin film transistors.

9. A driving method for the pixel circuit according to claim 1, comprising:

in a first stage, controlling the third thin film transistor to change the third thin film transistor from the off-state to the on-state by the first scan signal, and initializing the gate of the first thin film transistor and one end of the storage capacitor by the reference voltage, controlling the fourth thin film transistor to make the fourth thin film transistor set in the off-state by the second scan signal, controlling the second thin film transistor and the fifth thin film transistor to make the second thin film transistor and the fifth thin film transistor set in off-state by the third scan signal, and controlling the sixth thin film transistor to change the sixth thin film transistor from the on-state to the off-state by the first light-emitting control signal;

in a second stage, controlling the third thin film transistor to change the third thin film transistor from the on-state to the off-state by the first scan signal, controlling the fourth thin film transistor to make the fourth thin film transistor set in the off-state by the second scan signal, and controlling the second thin film transistor and the fifth thin film transistor to change the second thin film transistor and the fifth thin film transistor from the off-state to the on-state to compensate for the threshold voltage of the first thin film transistor by the third scan signal, and controlling the sixth thin film transistor to make the sixth thin film transistor set in the off-state by the first light-emitting control signal;

in a third stage, controlling the third thin film transistor to make the third thin film transistor set in the off-state by the first scan signal, and controlling the fourth thin film transistor to change the fourth thin film transistor from the off-state to the on-state by the second scan signal, applying a voltage to the other end of the storage capacitor by a data voltage, controlling the second thin film transistor and the fifth thin film transistor to change the second thin film transistor and the fifth thin film transistor from the on-state to the off-state by the third scan signal, and controlling the sixth thin film transistor to make the sixth thin film transistor set in the off-state by the first light-emitting control signal; and in a fourth stage, controlling the third thin film transistor to make the third thin film transistor set in the off-state by the first scan signal, controlling the fourth thin film transistor to change the fourth thin film transistor from the on-state to the off-state by the second scan signal, controlling the second thin film transistor and the fifth thin film transistor to make the second thin film transistor and the fifth thin film transistor set in the off-state by the third scan signal, controlling the sixth thin film transistor to change the sixth thin film transistor from the off-state to the on-state by the first light-emitting control signal, and emitting light by the light-emitting diode.

10. The driving method according to claim 9, wherein in the first stage, the voltage of the one end of the storage capacitor and the voltage of the gate of the first thin film transistor are both Vref, and Vref is the reference voltage.

11. The driving method according to claim 10, wherein in the third stage, the voltage of the other end of the storage capacitor changes from Vref to Vdata, and the voltage of the gate of the first thin film transistor is VDD−Vth+Vdata−Vref under the action of the storage capacitor, in the fourth stage, the current flowing through the light-emitting diode is independent of the first power source, wherein Vdata is the data voltage.

12. The driving method according to claim 9, wherein in the second stage, the gate of the first thin film transistor is connected to the drain of the first thin film transistor, and the first power source applies a voltage to the source of the first thin film transistor to make the voltage of gate of the first thin film transistor be VDD−Vth, and the threshold voltage of the first thin film transistor is compensated, wherein Vth is the threshold voltage of the first thin film transistor, and VDD is the first power supply.

13. The driving method according to claim 9, wherein when the pixel circuit comprises the seventh thin film transistor, and the source of the seventh thin film transistor is connected to the first power source, the drain of the seventh thin film transistor is connected to the source of the first thin film transistor and a gate of the seventh thin film transistor is connected to the second light-emitting control line, the driving method further comprises:

in the first stage, the second light-emitting control signal provided by the second light-emitting control line controls the seventh thin film transistor to change the seventh thin film transistor from the on-state to the off-state;

in the second stage, the second light-emitting control signal controls the seventh thin film transistor to change the seventh thin film transistor from the off-state to the on-state;

in the third stage, the second light-emitting control signal controls the seventh thin film transistor to change the seventh thin film transistor from the on-state to the off-state; and in the fourth stage, the second light-emitting control signal controls the seventh thin film transistor to change the seventh thin film transistor from the off-state to the on-state.

14. The driving method according to claim 9, wherein when the pixel circuit comprises the eighth thin film transistor, the source of the eighth thin film transistor is connected to the reference voltage signal line, the drain of the eighth thin film transistor is connected to the anode of the light-emitting diode and the gate of the eighth thin film transistor is connected to the fourth scan line, the driving method further comprises:

in the first stage, the fourth scan signal provided by the fourth scan line controls the eighth thin film transistor to change the eighth thin film transistor from the off-state to the on-state;

in the second stage, the fourth scan signal controls the eighth thin film transistor to change the eighth thin film transistor from the on-state to the off-state;

in the third stage, the fourth scan signal controls the eighth thin film transistor to make the eighth thin film transistor set in the off-state; and in the fourth stage, the fourth scan signal controls the eighth thin film transistor to make the eighth thin film transistor set in the off-state.

15. A display device, comprising the pixel circuit according to claim 1.

* * * * *